US006336307B1

(12) United States Patent
O'Connor

(10) Patent No.: US 6,336,307 B1
(45) Date of Patent: Jan. 8, 2002

(54) METHOD OF PACKAGING A STRIP OF MATERIAL FOR USE IN CUTTING INTO SHEET ELEMENTS ARRANGED END TO END

(75) Inventor: Lawrence J. O'Connor, Winnipeg (CA)

(73) Assignee: EKI Holding Corporation, Wilmington, DE (US)

( * ) Notice: Subject to any disclaimer, the term of this patent is extended or adjusted under 35 U.S.C. 154(b) by 0 days.

(21) Appl. No.: 09/370,240

(22) Filed: Aug. 9, 1999

Related U.S. Application Data

(63) Continuation-in-part of application No. 08/948,258, filed on Oct. 9, 1997, now abandoned, and a continuation-in-part of application No. 08/975,037, filed on Nov. 18, 1997, now Pat. No. 6,067,775.

(51) Int. Cl.[7] ..... B65B 63/04; B65B 63/02; B65B 31/04

(52) U.S. Cl. ..... 53/429; 53/434; 53/435; 53/438; 53/512; 53/117; 53/520; 53/529; 83/46; 83/333; 270/39.05; 493/357; 493/413

(58) Field of Search ..... 53/429, 116, 117, 53/435, 513, 520, 447, 541, 434, 438, 512, 529; 83/327, 332, 333, 343, 505, 496, 46, 425.3; 270/5.03, 21.1, 39.01, 39.03, 39.05; 493/356, 357, 358, 365, 361, 411, 414, 413

(56) References Cited

U.S. PATENT DOCUMENTS

| | | | | |
|---|---|---|---|---|
| 32,761 A | | 7/1861 | Elliot | |
| 1,029,459 A | | 6/1912 | Quigley | |
| 1,365,947 A | * | 1/1921 | Overbury | 493/413 X |
| 1,463,918 A | | 8/1923 | Borroughs | |
| 1,489,833 A | | 4/1924 | Keller | |

(List continued on next page.)

FOREIGN PATENT DOCUMENTS

| | | |
|---|---|---|
| AT | 181590 | 4/1951 |
| AU | 22983/83 | 5/1984 |
| DE | 1 141 610 | 12/1967 |
| DE | 2 225 061 | 5/1972 |
| EP | 0 274 737 | 12/1987 |
| EP | 0 383 501 | 8/1990 |
| FR | 1.357.816 | 7/1964 |
| GB | 2 028 774 | 3/1980 |
| GB | 2 193 734 | 2/1988 |
| JP | 57-47638 | 3/1982 |
| JP | 2-182666 | 7/1990 |
| SU | 1555205 | 4/1990 |
| WO | 99/35073 | 7/1999 |

*Primary Examiner*—Stephen F. Gerrity
(74) *Attorney, Agent, or Firm*—Darby & Darby

(57) ABSTRACT

A package of a strip of material has a plurality of parallel side by side stacks each containing a length of the strip which is folded back and forth such that each folded portion of the stack is folded relative to the next portion about a line transverse to the strip. Preferably, the side edges of the strip portions are aligned. The strip can be continuous through each stack and connected by a splice from the end of one stack to beginning of the next stack. To reduce the height of the stacks, the package is compressed and maintained in the compressed condition by, for example, an evacuated sealed bag. The strip of each stack is formed to have a varying width, for example to form diaper inserts when the strip is cut into individual strip elements. The length of each strip portion of the stack is arranged to equal a whole number of strip elements so that the cut lines can be arranged at the fold lines. The stacks are arranged with the side edges of the strips aligned and the wider parts of one stack nested within a narrower part of the next adjacent stack to minimize the package dimensions.

14 Claims, 8 Drawing Sheets

U.S. PATENT DOCUMENTS 1,754,676 A * 4/1930 Goergi ..... 83/333 X
1,985,676 A 12/1934 Hand
2,425,301 A 8/1947 Browner
2,530,319 A * 11/1950 Young ..... 83/333 X
2,659,187 A 11/1953 Barnes
3,245,680 A 4/1966 Harrison et al.
3,285,405 A 11/1966 Wanderer
3,321,889 A 5/1967 Zubik et al.
3,351,992 A 11/1967 Carter
3,429,095 A 2/1969 Huson
3,444,791 A * 5/1969 Honsel ..... 493/357
3,499,261 A 3/1970 Hullhorst et al.
3,627,306 A 12/1971 Affupper
3,632,103 A 1/1972 Nikitis
3,645,759 A 2/1972 Heiligman
3,673,757 A 7/1972 Willis
3,684,275 A 8/1972 Schweitzer et al.
3,697,062 A 10/1972 Mones et al.
3,729,367 A 4/1973 Shore et al.
3,739,544 A 6/1973 Hanemann
3,780,908 A 12/1973 Fitzpatrick et al.
3,913,904 A 10/1975 Occhetti
3,972,519 A 8/1976 Melzer
4,053,151 A 10/1977 Frezza
4,074,901 A 2/1978 Catallo
4,097,039 A 6/1978 Fischer
4,130,679 A 12/1978 Breznak et al.
4,174,101 A 11/1979 Frezza
4,201,029 A 5/1980 Lerner et al.
4,240,854 A 12/1980 Massey et al.
4,332,583 A 6/1982 Stemmler et al.
4,406,650 A 9/1983 Felix
4,418,514 A 12/1983 Spann
4,427,404 A 1/1984 Yamada
4,467,589 A 8/1984 van Maanen
4,493,689 A 1/1985 Affupper
4,499,707 A 2/1985 Desjobert et al.
4,512,464 A 4/1985 Sylvester
4,547,184 A 10/1985 Bunch, Jr.
4,573,670 A 3/1986 Felix
4,597,748 A 7/1986 Wolf
4,603,817 A 8/1986 O'Connor
4,670,001 A 6/1987 Campbell et al.
4,715,925 A 12/1987 Hofmeister et al.
4,716,706 A 1/1988 Boeckmann
4,730,762 A 3/1988 Felix
4,737,045 A 4/1988 Koefferlein
4,815,405 A 3/1989 Young, Jr.
4,824,426 A 4/1989 DuFresne
4,828,540 A 5/1989 Fordyce
4,829,918 A 5/1989 Young, Jr.
4,846,454 A 7/1989 Parkander
4,863,029 A 9/1989 Koskol et al.
4,896,475 A 1/1990 McAvinew
4,907,397 A 3/1990 Goodman
4,941,374 A 7/1990 Focke
5,029,828 A 7/1991 Sato et al.
5,036,977 A 8/1991 Schofield et al.
5,041,074 A 8/1991 Zwimpfer
5,042,789 A 8/1991 Hediger
5,047,003 A 9/1991 Schmidlin et al.
5,064,179 A 11/1991 Martin
5,085,624 A 2/1992 Felix
5,087,140 A 2/1992 Keeton et al.
5,104,366 A 4/1992 Bunch
5,147,273 A 9/1992 Rottmann et al.
5,177,934 A 1/1993 Yamamoto
5,201,700 A 4/1993 Meschi
5,205,808 A 4/1993 Gebhardt
5,242,057 A 9/1993 Cook et al.
5,290,226 A 3/1994 Green, Jr.
5,348,527 A 9/1994 Beckwith
5,358,140 A 10/1994 Pellegrino
5,529,564 A 6/1996 Hediger
5,558,318 A 9/1996 Crowley et al.
5,616,113 A 4/1997 Van Den Bergh
5,690,250 A 11/1997 Gooding, Jr. et al.
5,730,695 A 3/1998 Hauschild et al.

* cited by examiner

METHOD OF PACKAGING A STRIP OF MATERIAL FOR USE IN CUTTING INTO SHEET ELEMENTS ARRANGED END TO END

This application is a continuation in part of application Ser. No. 08/948,258 filed Oct. 9, 1997, now abandoned; and is a continuation in part of application No. 08/975,037 filed Nov. 18, 1997, now U.S. Pat. No. 6,067,775 issued May 30, 2000.

This application is related to copending applications on this subject matter:

Ser. No. 08/876,402 filed Jun. 16, 1997, now U.S. Pat. No. 5,921,064 issued Jul. 13, 1999;

Ser. No. 08/878,826 filed Jun. 19, 1997, now U.S. Pat. No. 6,035,608 issued Mar. 14, 2000;

Ser. No. 08/906,291 filed Aug. 5, 1997, now abandoned;

Ser. No. 08/939,815 filed Sep. 29, 1997, now U.S. Pat. No. 5,956,926 issued Sep. 28, 1999;

Ser. No. 08/939,444 filed Sep. 29, 1997, now abandoned;

Ser. No. 08/939,881 filed Sep. 29, 1997, now abandoned.

The disclosure of each of the above application is incorporated herein by reference.

I. BACKGROUND OF THE INVENTION

1. Field of the Invention

This invention relates to a method of packaging a strip of material. The method relates to material for use in cutting into sheet elements arranged end to end.

2. Description of Related Art

Strips of material are used for manufacture of diapers and other absorbent products. The strips are cut on the manufacturing line at longitudinally spaced transverse cut lines to divide the strip into individual sheet elements each used in the manufacture of a respective absorbent product. Generally these strips are also die cut to provide different widths for shaping of the products to better match the body of the user and for better aesthetics. Most current processes of this type die cut the elements from a single strip of the material having a width at least equal to the maximum required width and discard the waste at the sides formed by cutting away the side portions to the narrower scalloped width. Attempts are made to recycle the waste portions, generally by grinding and returning the materials to the strip manufacturer. However, recent developments have increased the complexity of the materials thus increasing the cost and making recycling more difficult. There is therefore industry pressure to reduce the amount of waste.

It has been previously proposed to longitudinally slit a web of the required materials into a plurality of side by side strips which have varying width. The shaping is arranged so that the strips have the wider portion of one adjacent to the narrower portion of the next and vice-versa. This eliminates or at least reduces the amount of waste relative to an arrangement in which all sheet elements are cut individually from a respective strip of constant width.

However, the packaging of such continuous strips is problematic as the strip of elements are of varied width so that the location of the side edges varies. One proposal is to form the strip into a single pancake roll or pad which is wound spirally. Another proposal is to wind the strip in a traverse package. Neither package structure is stable since the side edges of one wound layer do not directly overlie the side edges of the next leaving overhanging portions and feathered edges.

Previously, packages of a continuous strip of material have been formed using a technique known as "festooning" in which the strip is laid back and forth in a series of strip portions, with each portion being arranged relative to the next about a line generally transverse to the strip. The technique of festooning has been available for many years and is used in packaging many different types of materials but particularly material of a fibrous nature such as fabric, non-woven strips and the like. In this technique, the strip is conventionally guided into a receptacle such as a cardboard box while a first reciprocating movement causes portions of the strip to be laid across the receptacle and laid back and forth and a second reciprocating movement causes the positions of the portions to be traversed relative to the receptacle transversely to the portions. The strip portions thus partially overlay the adjacent strip portion in accordance with the dual reciprocating movements. Normally, the receptacle comprises a rigid rectangular container, at least partly of cardboard having a base and four upstanding sides. The sides prevent the loosely laid strips from sliding from the pile.

Festooning can be used for packaging strips of varying width, but this technique has significant disadvantages which inhibit the effectiveness of the product when removed and processed. In particular, fold lines created by laying the strip portions, which cannot be avoided, interfere with the absorbency or other performance of the material when such fold lines occur at a central area of the sheet element.

II. SUMMARY OF THE INVENTION

One aspect of the embodiments of this invention is to provide an improved package structure of a strip of material for cutting transversely of the sheet into a plurality of separate sheet elements arranged end to end.

According to one aspect of the invention there is provided a method of forming a package of a strip of sheet material comprising:

providing a strip of material having a first side edge, a second side edge defining a width therebetween, a first surface and a second surface, the strip having a width across the strip which varies along the length of the strip such that the width of the strip varies from areas of minimum width to areas of maximum width;

forming a plurality of stacks of the strip by folding the strip in each stack repeatedly back and forth to form a plurality of folded strip portions of the strip, with each folded strip portion of the strip being folded relative to one next adjacent folded strip portion about a first fold line transverse to the strip and relative to a second next adjacent folded strip portion about a second fold line transverse to the strip and spaced from the first fold line;

arranging the folded strip portions of each stack to form a plurality of first fold lines arranged at one of two opposed ends of the stack and a plurality of second fold lines arranged at the other of the ends of the stack;

arranging the folded strip portions of each stack superimposed each on the previous strip portion with the side edges thereof directly aligned such that the areas of maximum width of the folded strip portions are directly superimposed and areas of minimum width of the folded strip portions are directly superimposed and such that the fold lines of each stack at each end of the stack are aligned so as to lie in common planes;

and arranging the stacks side by side in a common package structure with the side edges of the folded strip portions of one stack adjacent to the side edges of the folded strip portions of a next adjacent stack, with alternate stacks having the fold lines thereof offset from the fold lines of next adjacent stacks in a direction longitudinal to the strip portions of the stacks, and with the stacks being nested such that the areas of minimum width of each stack lie alongside areas of maximum width of the next adjacent stack.

Preferably the fold lines of alternate stacks lie in common planes.

Preferably, the strip in each stack is continuous or designed to be integrally connected, at least to function as one piece, from an end connecting portion at one end of the stack to an end connecting portion at an opposed end of the stack. Each stack can include one end connecting portion of the strip from each stack for splicing to an end connecting portion of the strip of the next adjacent stack by a splice connecting portion of the strip to form a strip that is continuous along its length through the package.

Preferably, the stacks are substantially upright with a bottom and a top, two sides parallel to the edges of the strips of the stacks and two ends containing the fold lines of the stacks. The end connecting portion of the bottom of a stack can be connected to the end connecting portion of the top of a next adjacent stack to form the splice connecting portion that extends along one end of the stack.

Preferably, the package is compressed downwardly so as to decrease the height of the stacks from a rest height to a compressed height. The package can be engaged by packaging material which maintains the compression. Preferably, the compression is sufficient to reduce the thickness of each strip portion of said stacks. In the preferred compressed embodiment, the strip is fibrous.

The package can be wrapped by a flexible packaging material from which air is withdrawn and which is sealed against ingress of air. The flexible packaging material can be conventional shrink wrap, fabric, paper or a closed bag.

In one embodiment, the method includes applying to the strip of each stack a series of machine readable markings each at a longitudinal location on the strip arranged to identify a longitudinal location of a respective one of the fold lines. The method includes unfolding the strip, scanning the unfolded strip to locate the machine readable markings, and cutting the unfolded strip by using the machine readable markings to locate cut lines transverse to the strip at, adjacent to or at a predetermined distance from the fold lines.

According to a second aspect of the present invention there is provided a method of forming a package of a strip of sheet material comprising:

providing a strip of material having a first side edge, a second side edge defining a width therebetween, a first surface and a second surface, the strip having a width across the strip which varies along the length of the strip such that the width of the strip varies from areas of minimum width to areas of maximum width;

forming a plurality of stacks of the strip by folding the strip in each stack repeatedly back and forth to form a plurality of folded strip portions of the strip, with each folded strip portion of the strip being folded relative to one next adjacent folded strip portion about a first fold line transverse to the strip and relative to a second next adjacent folded strip portion about a second fold line transverse to the strip and spaced from the first fold line;

arranging the folded strip portions of each stack to form a plurality of first fold lines arranged at one of two opposed ends of the stack and a plurality of second fold lines arranged at the other of the ends of the stack;

arranging the folded strip portions of each stack superimposed each on the previous strip portion with the side edges thereof directly aligned such that the areas of maximum width of the folded strip portions are superimposed and areas of minimum width of the folded strip portions are superimposed and such that the fold lines of each stack at each end of the stack are aligned so as to lie in common planes;

and arranging the stacks in a common package structure with the stacks side by side such that the ends of the stacks lie at respective ends of the package, with the side edges of the folded strip portions of one stack adjacent to the side edges of the folded strip portions of a next adjacent stack, with the fold lines at one end of the stacks of all the stacks being aligned so as to lie in a first common plane at one end of the package and the fold lines at the other end of the stacks of all the stacks being aligned so as to lie in a second common plane at the other end of the package, and with the stacks being nested such that the areas of minimum width of each stack lie alongside areas of maximum width of the next adjacent stack.

BRIEF DESCRIPTION OF THE DRAWINGS

Preferred embodiments of the invention will now be described in conjunction with the accompanying drawings in which.

In the drawings, like reference numerals indicate corresponding parts that are the same in the different figures.

DETAILED DESCRIPTION OF PREFERRED EMBODIMENTS

Figure 1:
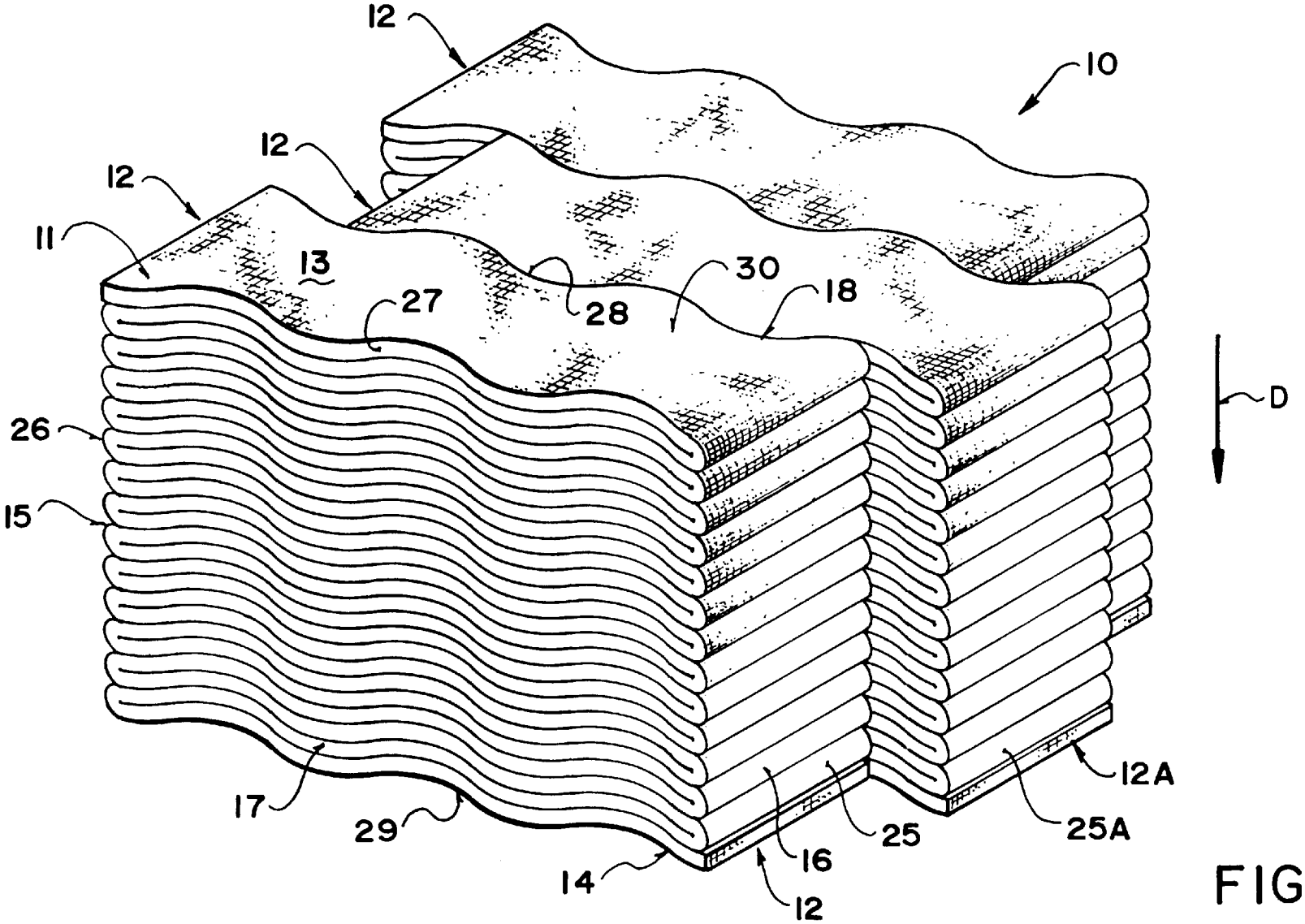
FIG. 1 is a schematic isometric view of a package of a continuous strip according to the present invention, the package including a plurality of stacks of the strip.
Figure 2:
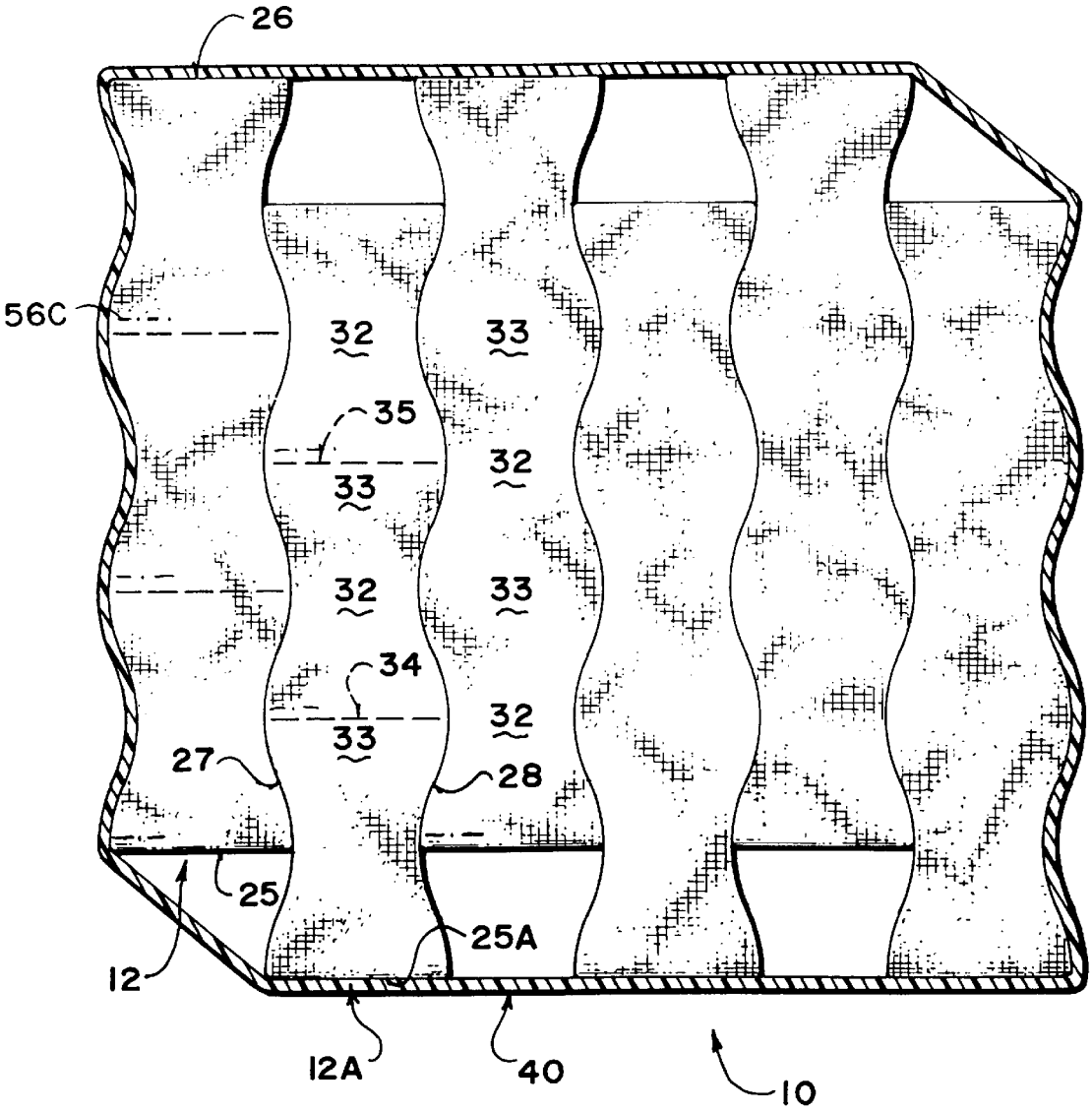
FIG. 2 is a top plan view of the package of FIG. 1, with the flexible packaging material included.

As shown in FIGS. 1 and 2, in the preferred embodiment the package comprises a generally rectangular body 10 formed from stacks 12 of a strip 11 of a material to be packaged. Generally, this material will be of a fibrous nature formed by woven or non-woven material, although this is not essential to the package structure. Many materials of various thicknesses can be packaged using the festooning technique provided the material can accept the creasing necessary at the end of each portion.

The package body is formed of a plurality of side by side stacks 12 of the strip 11. Each stack 12 comprises a plurality of folded strip portions of the strip, which are laid successively on top of one another. Thus, as shown in FIG. 1, the strip portions are folded back and forth at respective end fold lines 25 and 26 so that the fold lines of each stack lie in a common vertical plane defining the ends 15 and 16 of the stack. Each portion of the strip lies directly on top of the previous portion so that side edges 27 and 28 of the portions of the strip define a first set of lines in the common plane at right angles to the strip portions which contain all the side edges 27 of the stack. Similarly, the side edges 28 of the strips of the stacks define a second set of lines in the common plane at right angles to the strip portions which contain all the side edges 28 of the stack. Of course, if desired for the particular intended use of the packaged strip, the overlying strips may be separated by any appropriate material such as tissue, slip sheets, or friction reducing substances without affecting this invention.

Thus, the package is formed by stacking the portions each on top of the next from a bottom portion 29 up to a top portion 30 to form the stack. The package is thus formed from the plurality of stacks 12 each of which has a length preferably equal to that of the other stacks and therefore equal to that of the package. However, if desired variable lengths may be used. The stacks are preferably formed up to a common height, which is equal to the height of the package.

The package 10 is formed from a plurality of individual stacks 12 arranged side by side. In FIG. 1, there are shown only three such stacks for convenience of illustration, whereas in FIG. 2 there are shown six such stacks arranged side by side forming a complete package structure. Each stack is formed from a folded strip which is continuous through the stack or at least is integrally connected or functionally arranged to act as a continuous strip. Each stack has a top end 13, a bottom end 14, two ends 15 and 16 which are opposed and two sides 17 and 18 which are opposed.

It will of course be appreciated that the dimensions of the package can be varied according to requirements by the end user, for example, so that the number of stacks can be increased or decreased. The length and height of each stack can be varied to increase the number of folded strip portions and to increase the length of the folded strip portions.

As best shown in FIG. 2 in the plan view of the strips, the strips of each stack are folded back and forth from the fold lines 25 to the fold lines 26 to form a folded strip portion having a length equal to the distance between the fold lines.

As described hereinafter, the strips are cut so that they have a varying width between the side edges 27 and 28 of the strip. In the example shown, the strips are of a simple form in which the width varies periodically between narrow sections 32 and wider sections 33. More complex width variations can be employed in other examples, including stepped or serrated edges.

In the example shown, the strip is intended for manufacturing diapers or similar products which are formed each from a respective sheet element cut from the length of the strip. Each sheet element in the example shown has an intended cut line 34 at the wider section 33 and a second intended cut line 35 also at the wider section 33 so that the narrower section 32 is located between the intended cut lines.

It will be appreciated that in the package structure as shown, no cutting of the strips in the transverse direction has yet occurred, and the cut lines 34 and 35 are in effect imaginary lines. Their position can however be determined by the design of the sheet elements and the position along the length of the strip which forms the beginning and end of the sheet elements. The sheet elements are in effect thus arranged end to end so that each is separated from the next simply by cutting or otherwise separating the elements along the intended cut line.

The strip has a varying characteristic along its length which determines the position of the sheet elements on the strip and therefore determines the positions of the intended cut lines. In the example shown, the varying characteristic is the varying width. Other characteristics such as additional or different materials or varying thickness can be used.

It will be noted therefore from FIG. 2 that each folded strip portion of each of the package bodies is preferably defined by an exact whole number of sheet elements. In the example shown, the number of sheet elements is three but this can of course be varied from a minimum of one up to a maximum which depends solely upon to maximum allowable size of the transportable package structure. In most cases it is preferred that the folded strip portion will contain more than one sheet element since the sheet elements are often of the order of six inches to two feet in length and the required package structure will be generally significantly larger than this and generally of the order of four feet in length.

In the example shown, the design of the wider and narrower portions of the strip is arranged such that no waste is formed when the slitting action occurs, and the wider portions match exactly with the narrower portions of the next strips to minimize the package size. However, it is possible in some examples that there will not be an exact match between the wider portions of one strip and the narrower portions of the next adjacent strip so that so that some waste pieces will be formed by cutting out of the structure and discarding of those waste pieces.

Thus as shown in FIG. 2, in the preferred embodiment the strip portions will nest each exactly along side the next with the narrower portions of one receiving the wider portions of the next. In a situation where the wider portions do not exactly match the narrower portions, there will still be some nesting, which is effective to reduce the package size even though there may be spaces left between the folded strip portions.

The fact that each folded strip portion contains an exact whole number of sheet elements ensures that the cut lines occur directly at the fold lines. Thus there are no fold lines across the strip in any part of the sheet elements after the sheet elements are cut along the cut lines. This is desirable in that the absence of fold lines in the material of the sheet elements will avoid compromising the performance or absorbency of the sheet element in the main body of the sheet element.

Furthermore, the fact that the folded strip portion contains a whole number of the sheet elements and the sheet elements are identical ensures that the side edges of the each folded strip portion lie directly on top of the side edges of the previously laid folded strip portions. There are no overhanging or feathered edge portions therefore and all parts of the strip are fully contained within the stack. The stack is therefore in effect a solid structure having a constant density across its width. When compressed therefore the stack can form a very rigid structure with no possibility of damaging the side edges of the strip or of interleaving any material between the side edges of the strip.

In the examples shown in FIG. 2, in order to provide the nesting effect, because all of the package bodies are in effect identical with the fold lines arranged across the wider part of the strip, it is necessary to offset each stack relative to the next in a direction longitudinal of the strip. Thus each stack is offset by one half of the length of the sheet element. Thus for example the fold line 25A of the sheet element 12A is offset from the fold line 25 and the sheet element 12 by a distance equal to one half of the length of the sheet element from the fold line 25A to the cut line 34. However, the nesting effect of the stack provides an integral package structure when these are brought together and wrapped by the packaging material as described hereinafter.

Figure 6:
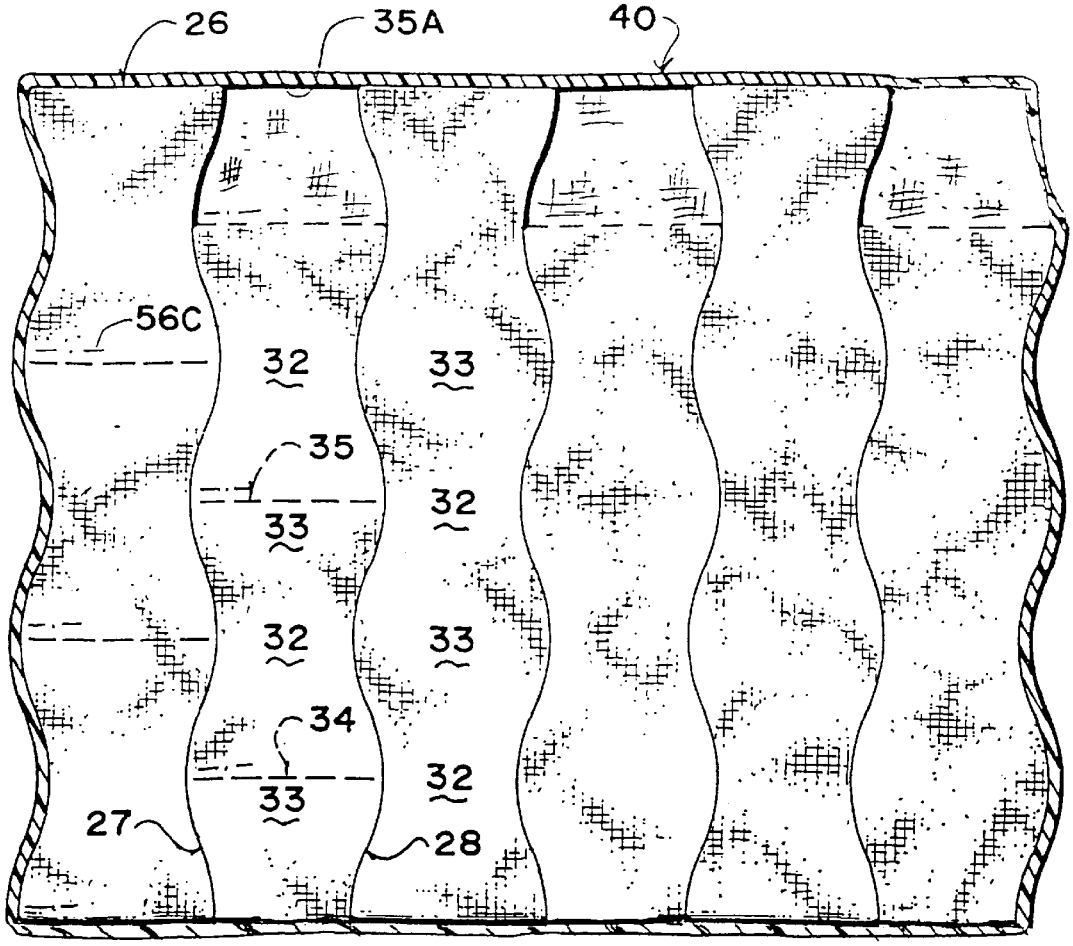
FIG. 6 is a top plan view of an alternative package structure similar to that of FIGS. 1 and 2 but with offset fold lines.

As shown in FIG. 6, an alternative arrangement can be provided in which the position of the fold lines relative to the sheet elements is of less importance. In this case, it is possible to accept a fold line 35A at a position along the length of the sheet element different from the intended cut line 35. Thus there is no necessity to offset the stacks longitudinally since the fold lines 35A at alternate ones of the stacks are arranged at the narrower parts 32 of the strip. Thus the fold lines are aligned but the sheet elements are longitudinally offset. In such a manner, the package structure can be directly rectangular apart from the outside edges which are shaped to follow the side edges of the outermost package bodies.

The package is wrapped by a flexible packaging material preferably of heat sealable non-permeable plastics which encompasses the whole of the package as indicated at 40 (not shown in FIG. 1). The packaging material forms a sealed package which allows air to be extracted from the package. This vacuum action can also be used with physical compression D from the top and bottom 13 and 14 of the package so as to compress the package to a reduced height in a vacuum packaging system. Of course, compression can be used without vacuum too. The amount of compression can be determined so as to minimize the volume of the package without interfering with the required loft of the product when withdrawn from the package. In this way the package structure avoids the necessity for rigid sides of a box or similar container so the package structure is stable due to the compression of the layers to reduce the height of the layers and due to the pressure of each layer against the sides of the next adjacent layers.

Compression of the package is only possible in the direction D, which is at right angles to the surfaces of the portions of the strip. This acts to compress the height of the stacks so that the thickness of each strip portion in the direction D is reduced by that compression. Compression along the portions or at right angles to the stacks is not possible since this will act to distort the strip. Mechanical compression therefore of the package in the direction D thus reduces the dimension of the package in that direction allowing the air to be withdrawn from the flexible packaging material 40 causing the packaging material to be pulled down onto the package to maintain it in its compressed condition and to apply pressures tending to hold the stacks in intimate contact. Further detail of the packaging and compression arrangement are shown in the above referenced applications.

Figure 7:
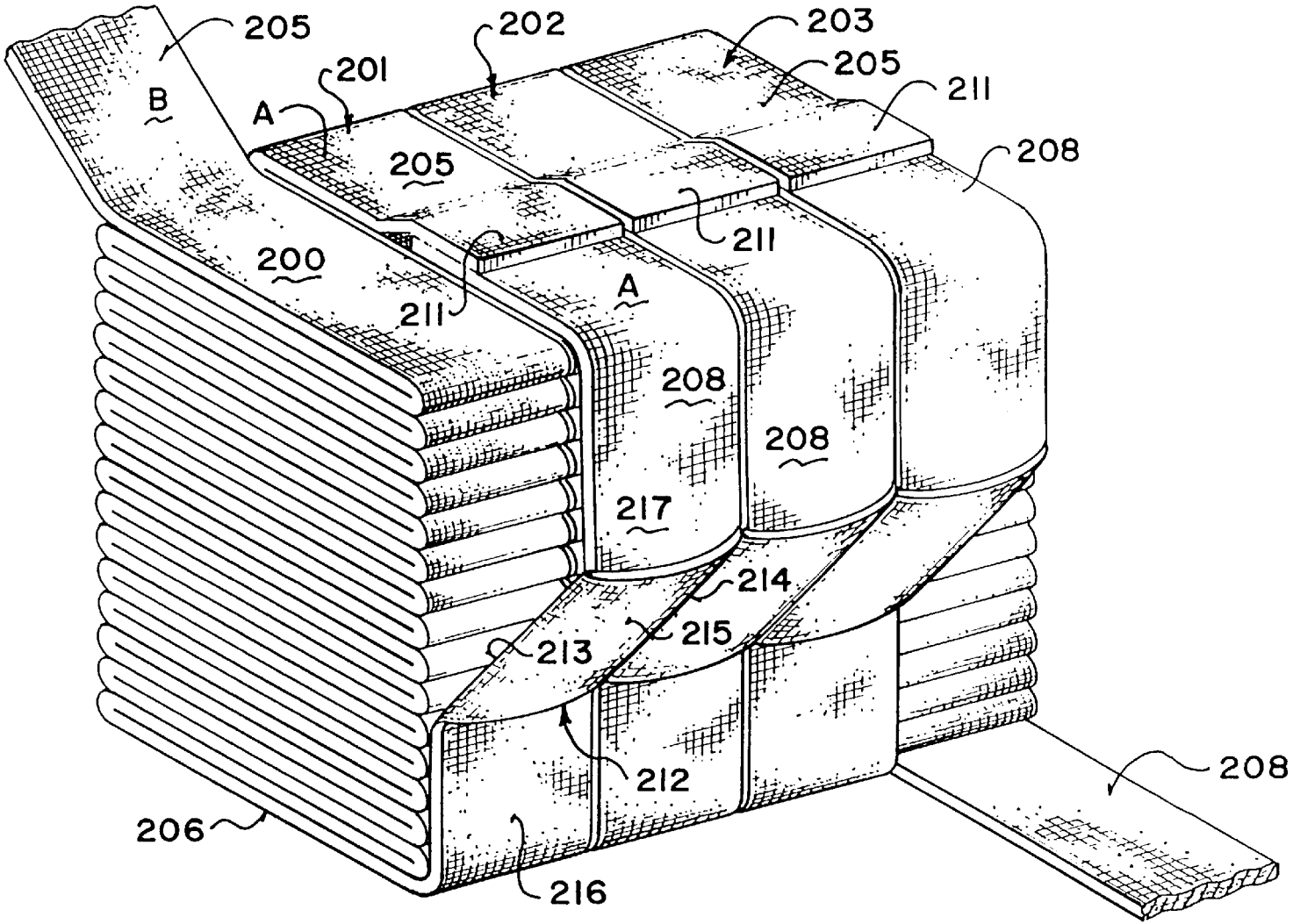
FIG. 7 is an isometric view of a package of the type similar to FIGS. 1 and 2 showing the spliced connections of each strip to the next but for convenience of illustration the strips are shown of constant width.

The strip of each layer is connected to the next by a traverse or spliced portion of the strip which extends from one stack to the next so as to form a continuous strip through the fill length of the package. The technique for connecting the strip of each stack to the next layer is shown and described in more detail in the above referenced applications and is shown in FIG. 7. In FIGS. 1 to 6, the spliced portion is simply omitted for convenience of illustration. Thus in FIG. 7 four stacks 222, 201, 202 and 203 are shown. The strip of each stack is continuous from a top strip portion 205 to a bottom strip portion 206. The connection is effected by a tail portion 208 which extends from the bottom portion 206 beyond one end of the stack. The portion 208 extends along the end of the stack at 216 and preferably includes a twist 215 with fold lines 213 and 214 to form a portion 217 extending along the end of the next adjacent stack. The portion 217 is connected by a splice 211 to the top portion 205 of the next adjacent stack. Other splicing arrangements are possible as described in more detail in the above copending applications.

Figure 3:
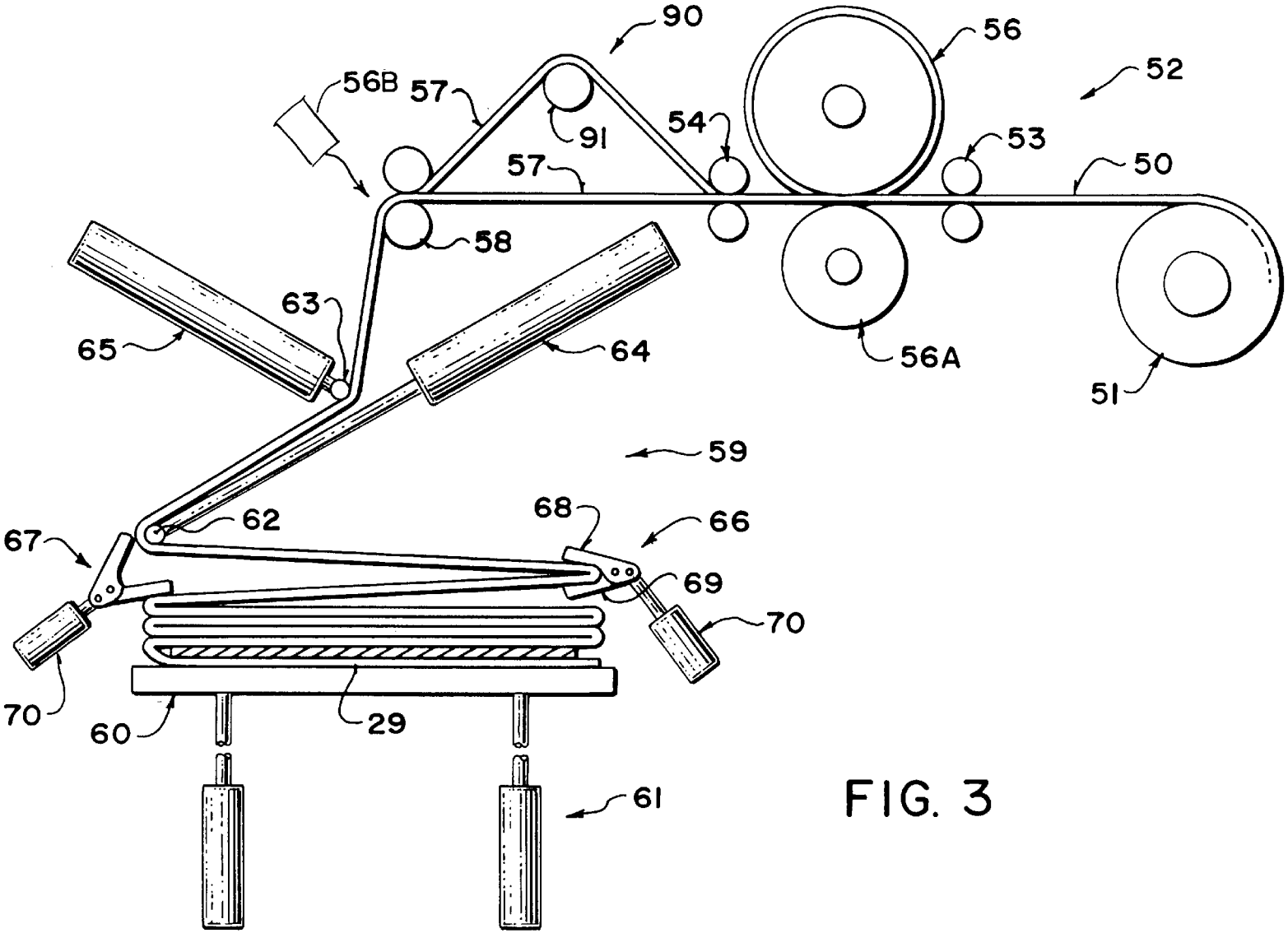
FIG. 3 is an end elevational view of an apparatus that can be used to practice the method for forming the package of FIG. 1.
Figure 4:
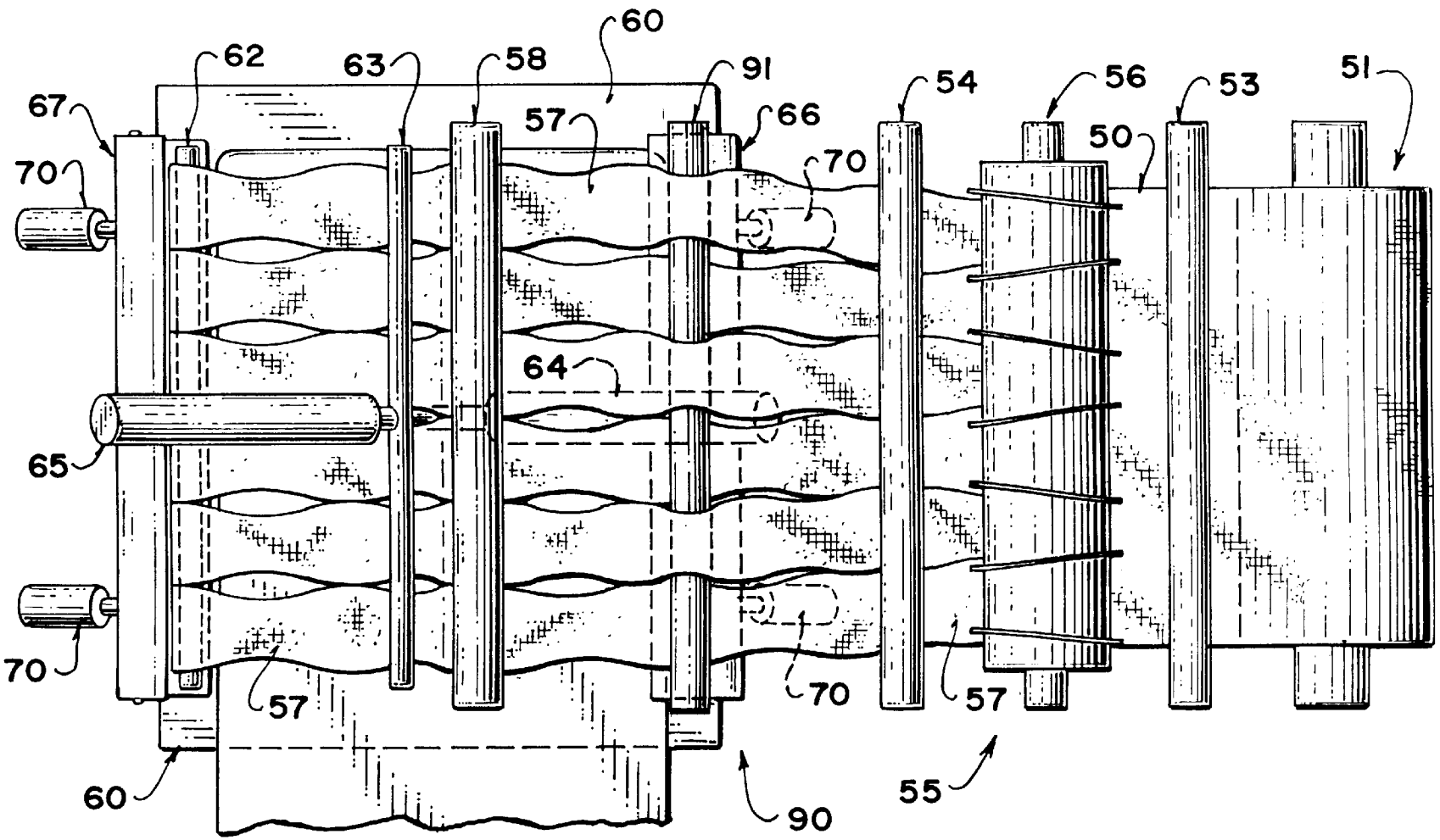
FIG. 4 is a top plan view of the apparatus of FIG. 5.
Figure 5:
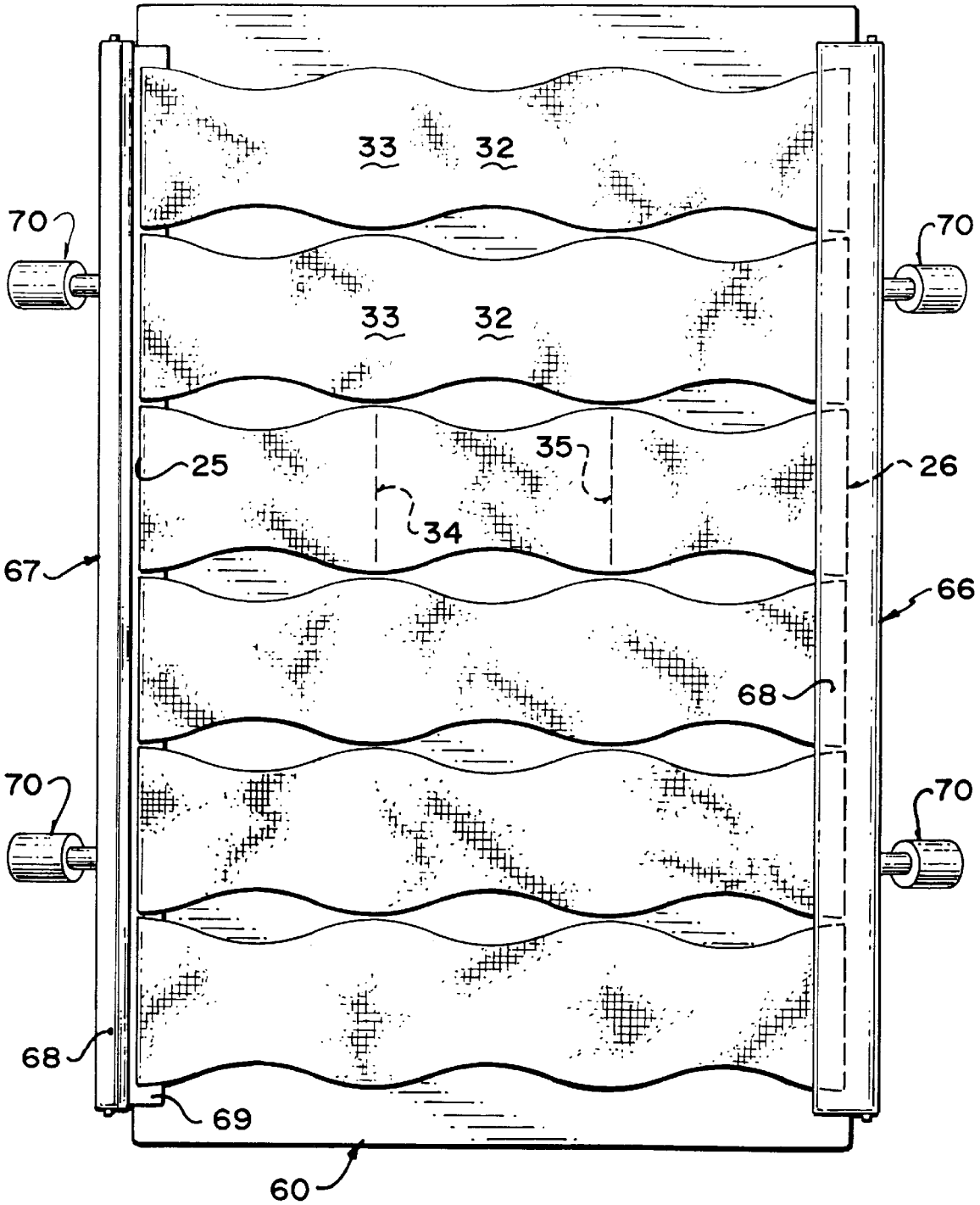
FIG. 5 is a top plan view of the platform of the apparatus of FIG. 4 showing the strips in spread arrangement for folding side by side.

Turning now to FIGS. 3, 4 and 5, a technique for forming the package structure is shown in more detail. A web 50 is supplied on a master roll 51 and is unwound from the master roll by a feeding and guide system 52 including two nip roller pairs 53 and 54. A slitting system 55 is mounted transversely to the web for dividing the web into a plurality of parallel side by side strips. This can be provided a by a slitter bar which carries a plurality of slitter knives at transversely spaced positions so as to slit the web into a plurality of strips 57 which are carried forwardly by the guide system 52 so that they are maintained in the common plane of the web and are maintained edge to edge. However, preferably the slitting system comprises a die cutting roller 56 which rolls on a platen 56A so as to cut the strips into the wider and narrower portions described hereinbefore. It is not necessary that the slitting be complete in that short connecting tabs may be left to hold the stacks in place during packaging. The tabs would then be torn during unfolding each successive stack.

In order to form the package structure shown in FIGS. 1 and 2 where the fold lines are arranged at the wider parts of the strip, it is necessary to spread the strips apart to take up the position shown in FIG. 5 and also to longitudinally offset the strips so that the wider portions 33 are aligned across the web and the narrower portions 32 are also aligned across the web. This movement is effected in a zone generally indicated at 90 which occurs between the rollers 54 and a guide roller 58. In this zone 90, the strips 57 are split apart by a suitable guide system well known to one skill in the art. Alternate ones of the strips are passed over a diverting roller 91 which increases the path length by a distance equal to one half of the length of a sheet element so as the strips pass through the guide rollers 58 they are aligned into the position shown in FIG. 5.

The strips 57 are fed over a guide roller 58 into a folding system generally indicated at 59 located underneath the feed roller 58. The folding system 59 comprises a support table 60 having a width sufficient to receive the full width of the web 50 when stretched out as shown in FIG. 5, that is the strips are in side by side arrangement. The support table 60 has a length sufficient to receive the portions of the folded strips in the structure as previously described. The table 60 is mounted upon a jacking system 61 which is shown only schematically and acts to raise and lower the table so that the table is gradually lowered as the strips are folded onto the table.

The folding system further includes a pair of folding bars 62 and 63 which act to fold the strips back and forth across the table 60. The folding bar 62 is mounted on an actuating cylinder 64 and similarly the folding bar 63 is mounted on an actuating cylinder 65. In FIG. 3, the folding bar 63 is shown in the retracted position and the folding bar 62 is shown in the extended position. The folding bars move alternately between these positions so that the folding bar 62 is firstly retracted and then the folding bar 63 is extended so as to move the strips across the table to form the overlying portions of the strip previously described. The folding bars 62 and 63 extend across the full width of the web so as to engage all of the strips simultaneously and to move those strips simultaneously into the folded positions. The strips thus remain in the above described position as they are being folded. The folding bars 62 and 63 may be in the form of rollers to allow the material to pass over the bar without friction while the material is being pushed by the bar to the required position on the table. The mounting system for supporting the cylinders is not shown for convenience of illustration and this will of course be well apparent to one skilled in the art.

The folding system further includes a pair of creasing jaws 66 and 67 each arranged at the end of the stroke of a respective one of the folding bars. The creasing jaws also extend across the full width of the web and comprise a pair of jaw elements 68 and 69 which can be moved from an open position as indicated on the left and a closed creasing position as indicated on the right. The jaws are moved between these positions by an actuating cylinder 70 timed in relation to the operation of the cylinder 64 and 65. In addition to the opening and closing movement, the creasing jaws also move inwardly and outwardly in a horizontal direction relative to the table so as to release each fold or crease line after it is formed to allow that stack and the fold at the end of the stack to be dropped onto the previous stacks and to move downwardly with the table 60. Thus as illustrated, the creasing jaw 66 at the completion of the crease moves outwardly away from the crease or fold line and at the same time opens slightly to release the fold between the two portions to drop downwardly onto the underlying portions. The jaws then open and move back inwardly ready to receive the portion of the strips wrapped around the folding bar and to grasp those as they are released from the folding bar as shown at the creasing jaw 67 in FIG. 5. This compound motion can be effected by suitable mechanical linkage operated by the actuating cylinder 70, this arrangement again being well apparent to one skilled in this art.

The strips are therefore simultaneously laid down in portions folded back and forth on top of one another to simultaneously form a plurality of the stacks of the package structure. Each stack is thus formed by a single respective one of the strips. The strip is continuous throughout the stack. In order to provide a continuous strip, one or more master rolls may be spliced into the supply with the splice being formed across the width of the web so that each slit strip also acts to slit through the splice.

The back and forth folding of the strips into the stacks is continued until sufficient of the portions are applied to the stack to complete the stack in accordance with the required dimensions of the stack.

A modified method for manufacturing the package of the structure as shown in FIGS. 1 and 2 uses basically the steps shown in FIGS. 3, 4 and 5 but instead of using the slitter system 55 uses the cutting method shown in and described in the above referenced applications in which a folded web is cut using a band knife across the folded structure. Such an arrangement will form a package structure in which the individual package bodies are fully nested with the fold lines aligned so that is not possible to manufacture such a structure in which the fold lines are all located at the intended cut lines of the sheet elements.

In a yet further modified method for manufacturing the package, each individual strip separated from the slitting system 55 can be transported to an individual folding head where the strip is folded back and forth as previously describe to form individual package bodies. When the individual package bodies are so formed, they can be collated and nested on a suitable collation platform for subsequent compression and wrapping as previously described.

A marker 56B is located adjacent the packaging system 59 for applying an optional machine readable marking 56C on the strip in registration with the intended cutting lines for dividing each sheet element from the next. The markings shown as a chain dot line in FIGS. 2 and 6 can comprise an ink jet marking, possibly in the form of a dot or square, visible both to the eye and to the machine or, in some cases, just detectable to the machine. The marking may or may not be located directly at the cut line depending upon the location of the machine reader relative to the cutting blade. In the example shown, the marking is located in advance of the intended cut line. The marking may extend only across a short part of the width of the strip. It will be appreciated that as the markings are registered with respective ones of the cut lines, each marking is offset from its associated cut line by the same distance. In an arrangement in which only the fold lines are marked by the ink jet marking, there will be only one marking on each strip portion. In an arrangement in which the number of sheet elements on each strip portion is a whole number greater than one, each intended cut line can be marked. Therefore, in this case there will be a plurality of markings on each strip portion.

Figure 8:
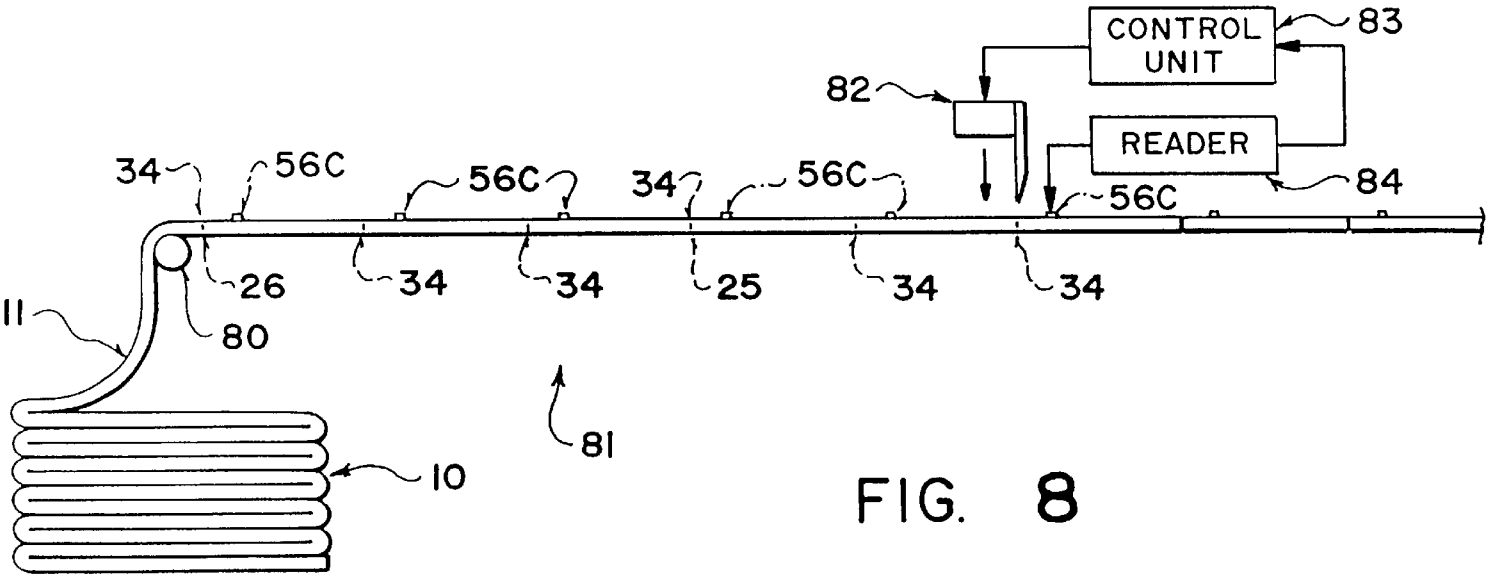
FIG. 8 is a schematic side elevational view of a manufacturing line for cutting the strip into sheets.
Figure 9:
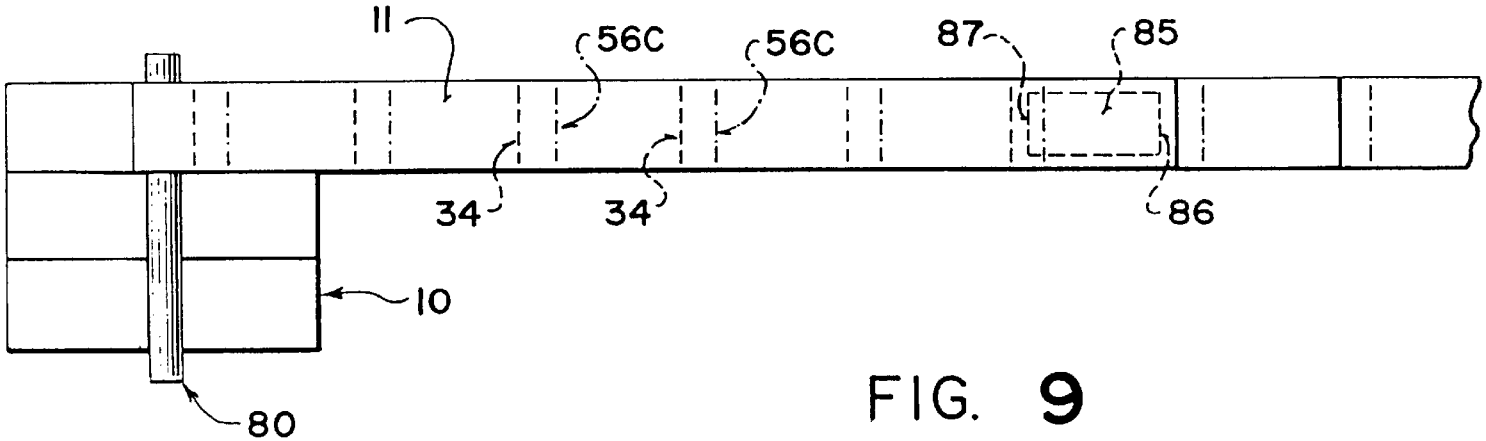
FIG. 9 is a top plan view of the line of FIG. 8.

Turning now to FIGS. 8 and 9, there is shown schematically the unfolding and cutting line for using the strip and separating the strip into the separate sheet elements. Thus, the package is indicated at 10 and the strip is withdrawn from the package over a guide member 80 for directing into an operating line 81. A cutting device 82 is operated by a control unit 83 which receives registration information from the markings 56C as read by a reader 84. Thus the markings are located at a position to operate the control device to effect cutting at the intended cut line.

As explained previously, some of the cut lines are located at the fold lines. Depending upon tolerances, the cut may not be effected directly at the fold line but may deviate slightly therefrom. As the sheet elements are often intended to be stitched or otherwise formed into a final product, with edges of the sheet element thus being formed into edges of the final product, the cut line can deviate from the fold line by a small amount provided the fold line does not end up in a central absorbent area 85 of the final product, indicated by dash lines 86, 87. That is, the fold lines are preferably arranged sufficiently close to an end of the sheet elements to avoid compromising the performance of the sheet elements.

Since various modifications can be made in the invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of forming a package of a strip of sheet material comprising:

providing a strip of material having a first side edge, a second side edge defining a width therebetween, a first surface and a second surface, the strip having a width across the strip which varies along the length of the strip such that the width of the strip varies from areas of minimum width to areas of maximum width;

forming a plurality of stacks of the strip by folding the strip in each stack repeatedly back and forth to form a plurality of folded strip portions of the strip, with each folded strip portion of the strip being folded relative to one next adjacent folded strip portion about a first fold line transverse to the strip and relative to a second next adjacent folded strip portion about a second fold line transverse to the strip and spaced from the first fold line;

arranging the folded strip portions of each stack to form a plurality of first fold lines arranged at one of two opposed ends of the stack and a plurality of second fold lines arranged at the other of the ends of the stack with the fold lines at one end of the stacks of all the stacks being aligned so as to lie in a first common plane at one end of the package and the fold lines at the other end of the stacks of all the stacks being aligned so as to lie in a second common plane at the other end of the package;

arranging the folded strip portions of each stack superimposed each on the previous strip portion with the side edges thereof directly aligned such that the areas of maximum width of the folded strip portions are superimposed and areas of minimum width of the folded strip portions are superimposed and such that the fold lines of each stack at each end of the stack are aligned to lie in common planes;

arranging the stacks side by side in a common package structure such that the ends of the stacks lie at respective ends of the package, with the side edges of the folded strip portions of one stack adjacent to the side edges of the folded strip portions of a next adjacent stack, with the stacks being nested such that the areas of minimum width of each stack lie alongside areas of maximum width of the next adjacent stack;

wherein the strip in each stack is continuous from an end connecting portion at one end of the stack to an end connecting portion at an opposed end of the stack and including splicing one end connecting portion of the strip from each stack to an end connecting portion of the strip of a next stack by a splice connecting portion of the strip to form a strip that is continuous along its length through the package.

2. The method according to claim 1 including arranging the stacks substantially upright with a bottom and a top, two sides parallel to the edges of the strips of the stacks and two ends containing the fold lines of the stacks, and connecting the end connecting portion of the bottom of a stack to the end connecting portion of the top of a next stack to form the splice connecting portion which extends along one end of the stack.

3. The method of claim 2, wherein the end connecting portion of the bottom of a stack is connected to the end connecting portion of the top of a next adjacent stack to form the splice connecting portion.

4. The method according to claim 1 including compressing the package downwardly to decrease the height of the stacks from a rest height to a compressed height, and engaging the package by packaging material which maintains the compression.

5. The method according to claim 4 wherein the compression is sufficient to reduce the thickness of each strip portion of said stacks.

6. The method according to claim 5 wherein the strip is fibrous.

7. The method according to claim 4 including wrapping the package by a flexible packaging material to form a closed bag, withdrawing air, and sealing against ingress of air.

8. The method according to claim 1 including the steps of: applying to the strip of each stack a series of machine readable markings each located at a longitudinal location on the strip which is arranged to identify a longitudinal location of a respective one of the fold lines; unfolding the strip; scanning the unfolded strip to locate the machine readable markings; and cutting the unfolded strip by using the machine readable markings to locate cut lines transverse to the strip at or adjacent the fold lines.

9. A method of forming a package of a strip of sheet material comprising:

providing a web of a sheet material;

forming longitudinally extending, transversely spaced slit lines in the web by which the web is divided longitudinally into a plurality of side by side strip elements;

arranging the dividing lines such that each strip element is longitudinally continuous through the length of the web and such that the dividing lines diverge from a parallel straight condition such that each strip element varies in shape along the length of the strip element;

folding the web repeatedly back and forth so as to define a stack of web portions wherein each web portion is folded relative to one next adjacent folded web portion about a first fold line transverse to the web and relative to a second next adjacent folded web portion about a second fold line transverse to the web and spaced longitudinally from the first fold line; and connecting an end connecting portion of each strip element by a splice connecting portion to an end connecting portion of a another strip element to form a strip that is continuous along its length through the package.

10. The method according to claim 9 including arranging the stacks substantially upright with a bottom and a top, two sides parallel to the edges of the strip elements of the stacks and two ends containing the fold lines of the stacks, and connecting the end connecting portion of the bottom of a stack to the end connecting portion of the top of another of the stacks to form the splice connecting portion which extends along one end of the stack.

11. The method according to claim 9 including compressing the package downwardly so as to decrease the height of the stacks from a rest height to a compressed height, and engaging the package by packaging material which maintains the compression.

12. The method according to claim 11 wherein the compression is sufficient to reduce the thickness of each strip portion of said stacks.

13. The method according to claim 12 wherein the strip is fibrous.

14. The method according to claim 11 including wrapping the package by a flexible packaging material forming a closed bag, withdrawing air and sealing the packaging material against ingress of air.

* * * * *

UNITED STATES PATENT AND TRADEMARK OFFICE

CERTIFICATE OF CORRECTION

PATENT NO. : 6,336,307 B1
DATED : January 8, 2002
INVENTOR(S) : Lawrence J. O'Conner It is certified that error appears in the above-identified patent and that said Letters Patent is hereby corrected as shown below:

Title page,
Item [73], Assignee, delete "EKI Holding Corporation" and replace with -- BKI Holding Corporation --

Signed and Sealed this

Twenty-third Day of July, 2002

*Attest:*

*Attesting Officer*

JAMES E. ROGAN
*Director of the United States Patent and Trademark Office*